US010138634B2

(12) United States Patent
Erekson et al.

(10) Patent No.: US 10,138,634 B2
(45) Date of Patent: Nov. 27, 2018

(54) FLASHING CLIPS

(71) Applicants: Craig Erekson, Winder, GA (US); Levi Erekson, Winder, GA (US)

(72) Inventors: Craig Erekson, Winder, GA (US); Levi Erekson, Winder, GA (US)

( * ) Notice: Subject to any disclaimer, the term of this patent is extended or adjusted under 35 U.S.C. 154(b) by 0 days.

(21) Appl. No.: 15/581,583

(22) Filed: Apr. 28, 2017

(65) Prior Publication Data

US 2017/0342718 A1 Nov. 30, 2017

Related U.S. Application Data

(60) Provisional application No. 62/341,000, filed on May 24, 2016.

(51) Int. Cl.

| | |
|---|---|
| ***E04D 1/36*** | (2006.01) |
| ***E04D 3/38*** | (2006.01) |
| ***E04D 13/14*** | (2006.01) |
| ***E04D 13/147*** | (2006.01) |

(52) U.S. Cl.
CPC ..... *E04D 13/1476* (2013.01)

(58) Field of Classification Search
CPC ..... E04B 13/1476; E04B 1/54; E04B 1/6112; E04B 2001/6191; E04B 7/08; E04D 13/04; E04D 13/15; E04D 13/17; E04D 13/1475
USPC ..... 52/60, 199
See application file for complete search history.

(56) References Cited

U.S. PATENT DOCUMENTS

| | | | | |
|---|---|---|---|---|
| 572,761 | A * | 12/1896 | Lambrecht et al. | E04D 13/1476 285/43 |
| 917,167 | A * | 4/1909 | Shaw | E04D 13/1476 126/315 |
| 4,570,396 | A * | 2/1986 | Struben | E04B 7/00 52/199 |
| 4,937,991 | A * | 7/1990 | Orth | E04D 13/1407 138/157 |
| 5,746,031 | A * | 5/1998 | Burns | A62C 2/00 248/519 |
| 2003/0089047 | A1* | 5/2003 | Nichols, Jr. | H02G 3/14 52/60 |
| 2017/0030491 | A1* | 2/2017 | Lechuga | F16L 5/10 |

* cited by examiner

*Primary Examiner* — Brian D Mattei
(74) *Attorney, Agent, or Firm* — Jones IP Law, LLC; Dennis W. Jones

(57) ABSTRACT

A flashing clip that provides for securing placement of a flashing material is provided. The flashing clip includes a pair of symmetrical base plates collectively forming a width adjustable base plate having an outer and inner edge opposing each other, a first and second end opposing each other, foldable edge clips along each outer edge, foldable end clips along each first end, a tab extended from each outer edge adjacent the second end, and an aperture opposite each tab, and extending from each second end toward each inner edge, and the inner edges aligned adjacent each other to collectively provide adjustable spacing to partially enclose an object extending from a roof when the base plate is placed thereon, wherein the flashing clip is adjustably attachable via fasteners so that the flashing clip provides for securing placement of a flashing material around an object extended from the roof.

17 Claims, 15 Drawing Sheets

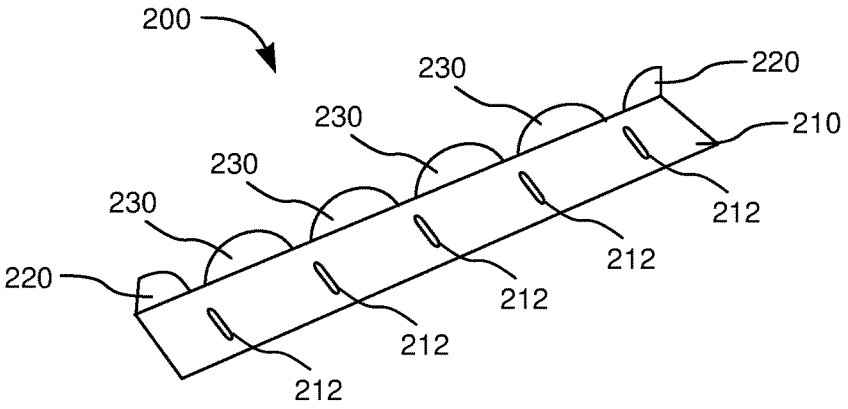
Fig. 14-A
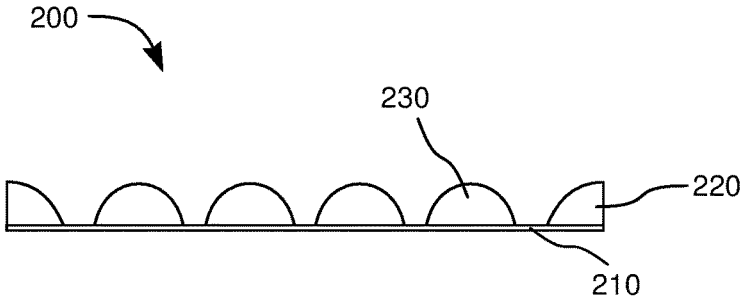
Fig. 14-B
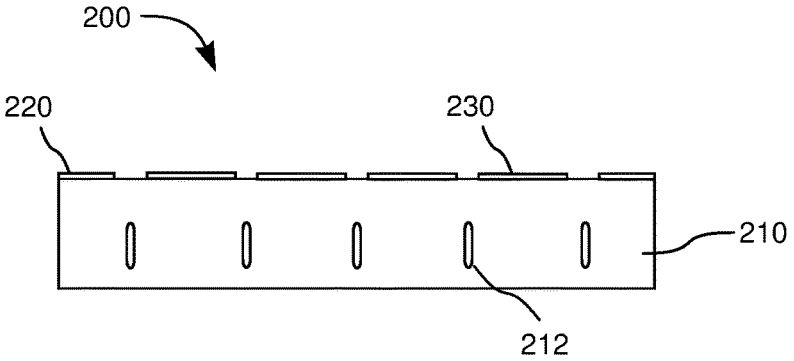
Fig. 14-C

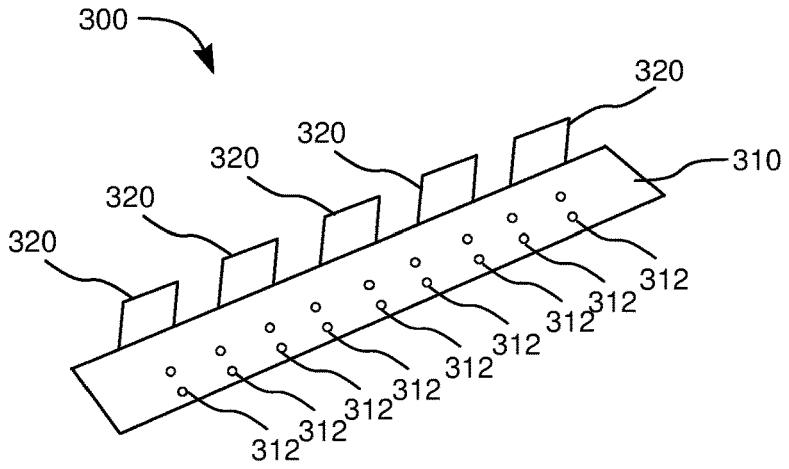
Fig. 15-A
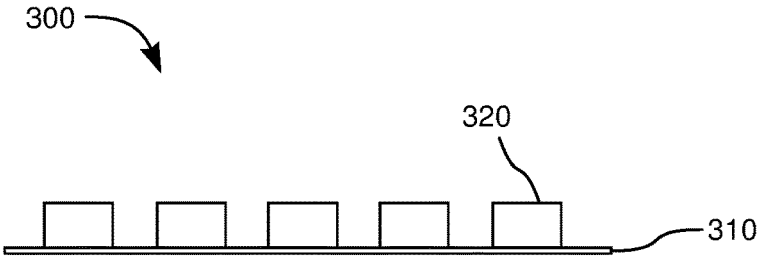
Fig. 15-B
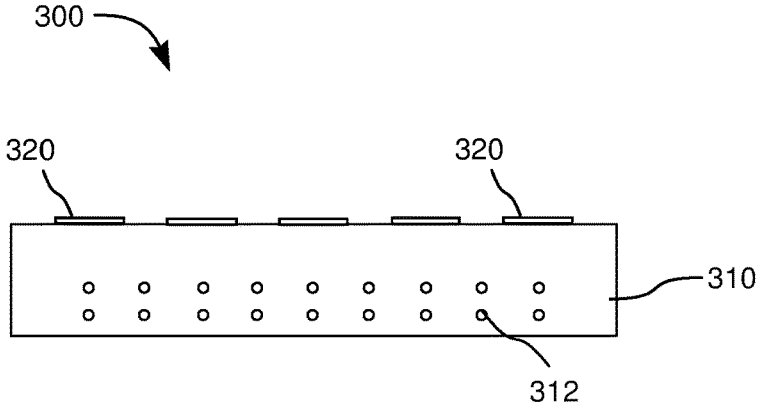
Fig. 15-C

FLASHING CLIPS

CROSS-REFERENCE TO RELATED APPLICATIONS

This application claims the benefit of U.S. Provisional Patent Application No. 62/341,000, entitled "Flashing Clips," filed May 24, 2016, which is incorporated herein by reference as if set forth herein in its entirety.

BACKGROUND

This invention pertains to flashing clip devices. More particularly, this invention pertains to flashing clips for securement of weatherproofing flashing components utilized for sealing joints in roof construction.

For residential homes, the main purpose of a roof is to protect against weather, and particularly against water. Flashing components are utilized at edges such as perimeters, penetrations, walls, expansion joints, valleys, drains, and any other interruption or termination of the roof's protective covering. For example, membrane base flashing covers the edge of the field membrane such as horizontal-to-vertical intersections where it extends up the vertical surface. Cap flashings or counterflashings shield the upper edges of the base flashing.

Roof flashing is used at discontinuities in the roof or where objects protrude from the roof and is also used in dips or valleys where runoff concentrates. In such instances, the roof flashing serves to deflect water away from the various seams or joints. Roof flashing as an engineering technique has been known for hundreds of years and depends almost entirely on gravity. Correct installation of the flashing allows gravity to work with the flashing material to direct the water onto regular roofing materials and then to the ground or other drainage. Specifically, roof flashing is commonly utilized around chimneys, air vents, plumbing vent stacks, and any other items that are likely to project from residential roofs.

Flashing, or weatherproofing, often traditionally refers to the practice of utilizing thin or sheet type pieces of metal to prevent the flow of water into or through the joints of a structure. Flashing can be concealed or exposed according to the particular use or situation. Roofs that include pipes extending through the roof for various reasons often utilize exposed flashing of a sheet metal type that is nailed or otherwise fastened to the roof, either under or above the shingles. It is preferable for any type flashing to be installed prior to the shingles so that the later installed shingles can divert water away from any nails or fasteners and prevent leaks.

Repairs, however, often complicate installation matters as shingles must be at least partially removed to effect repair. Preventing leaks during and after repairs inevitably becomes more complex due to the use of nails and/or caulking.

BRIEF SUMMARY

According to one embodiment of the present invention, a flashing clip includes a base type tray with an opening and tailored to a pipe flashing unit so that the flashing clip is permanently attachable to a roof and the pipe flashing unit is secured in position within the base tray via foldable clips.

According to another embodiment, a flashing clip provides for securing a pipe flashing unit in place without the need for caulking or other sealants. A pipe flashing unit is secured within the flashing clip via foldable clips so that nails or fasteners utilized to secure the flashing clip in place on the roof are covered by the pipe flashing unit. Exposed nails are eliminated so that no water or rain reaches the nails under the pipe flashing unit. Shingles finish the securement of the pipe flashing unit by covering the folded clips above its upper portion.

According to one embodiment, a flashing clip includes a metal base plate having an opening, a pair of tabs, a number of foldable side clips, and a number of foldable end clips. In one embodiment, the metal base plate is rectangular in shape.

According to one embodiment, a flashing clip that provides for securing placement of a flashing material includes (1) a base plate, (2) a plurality of foldable edge clips along opposing edges of the base plate, (3) a plurality of foldable end clips along a first end of the base plate, (4) a pair of opposing tabs extended from each of the opposing edges of and adjacent a second end of the base plate, and (5) an aperture between the opposing edges extending from the second end toward the first end, and providing spacing for partially enclosing an object extending from a roof when the base plate is placed thereon, wherein the flashing clip is attachable via fasteners to a roof so that the flashing clip provides for securing placement of a flashing material around an object extended from the roof.

In one embodiment, the tabs include a tab hole for attachment via fasteners to a specific location on the roof. In another embodiment, the base plate includes a plurality of fastener holes for attachment via additional fasteners to the roof.

In one embodiment the aperture extends at least half the base plate length.

In one embodiment, the base plate is a thin material. In various embodiments, the base plate is made from aluminum, sheet metal, stainless steel, galvanized steel, and/or any foldable material.

According to another embodiment, a flashing clip that provides for securing placement of a flashing material includes (1) a pair of symmetrical base plates collectively forming a width adjustable base plate that includes (a) an outer edge and an inner edge opposing each other, (b) a first end and a second end opposing each other, (c) a plurality of foldable edge clips along the outer edge of each symmetrical base plate, (d) a plurality of foldable end clips along the first end of each symmetrical base plate, (e) a tab extended from the outer edge and adjacent the second end of the symmetrical base plate, and (f) an aperture opposite the tab, and extending from the second end toward the inner edge, and (2) the inner edge of each symmetrical base plate aligned adjacent each other so that the apertures collectively provide adjustable spacing to partially enclose an object extending from a roof when the base plate is placed thereon, wherein the flashing clip is adjustably attachable via fasteners to a roof so that the flashing clip provides for securing placement of a flashing material around an object extended from the roof.

In one embodiment, the tabs include a tab hole for attachment via fasteners to a specific location on the roof. In another embodiment, the symmetrical base plates include a plurality of fastener holes for attachment via additional fasteners to the roof.

In one embodiment each aperture extends at least half the distance of the symmetrical base plate.

In one embodiment, each symmetrical base plate is a thin material. In various embodiments, each symmetrical base plate is made from aluminum, sheet metal, stainless steel, galvanized steel, and/or any foldable material.

Another embodiment provides for installation via placing the flashing clip around a pipe extending from the roof to determine an approximate installation position. A pipe flashing unit is positioned in place within the side clips and end clips of the flashing clip. Once the pipe flashing unit is in the correct location, fasteners are utilized at each tab to attach the flashing clip in the marked as correct position. Once the flashing clip is attached in place via fasteners or nails through the fastener openings of the tabs, the pipe flashing unit is temporarily removed so that the installer (or roofer) can drive a number of nails through at least some of the fastener holes to permanently secure the flashing clip in place. After permanently securing the flashing clip with nails or other fasteners, the pipe flashing unit is placed at its correct location within the flashing clip, and the side clips and end clips are folded over the edges of the pipe flashing unit to secure it permanently in place. The installation is completed by re-attaching roof covering materials such as shingles to permanently cover the flashing clip.

Other systems, methods, features and advantages of the present invention will be or become apparent to one with skill in the art upon examination of the following drawings and detailed description. It is intended that all such additional systems, methods, features and advantages be included within this description and be within the scope of the present disclosure.

BRIEF DESCRIPTION OF THE DRAWINGS

The above-mentioned features will become more clearly understood from the following detailed description read together with the drawings in which:

FIG. 14-A is a perspective view of a universal flashing clip;

FIG. 14-B is a side view of a universal flashing clip;

FIG. 14-C is a top view of a universal flashing clip;

FIG. 15-A is a perspective view of an alternative universal flashing clip;

FIG. 15-B is a side view of an alternative universal flashing clip;

FIG. 15-C is a top view of an alternative universal flashing clip;

DETAILED DESCRIPTION

Figure 1:
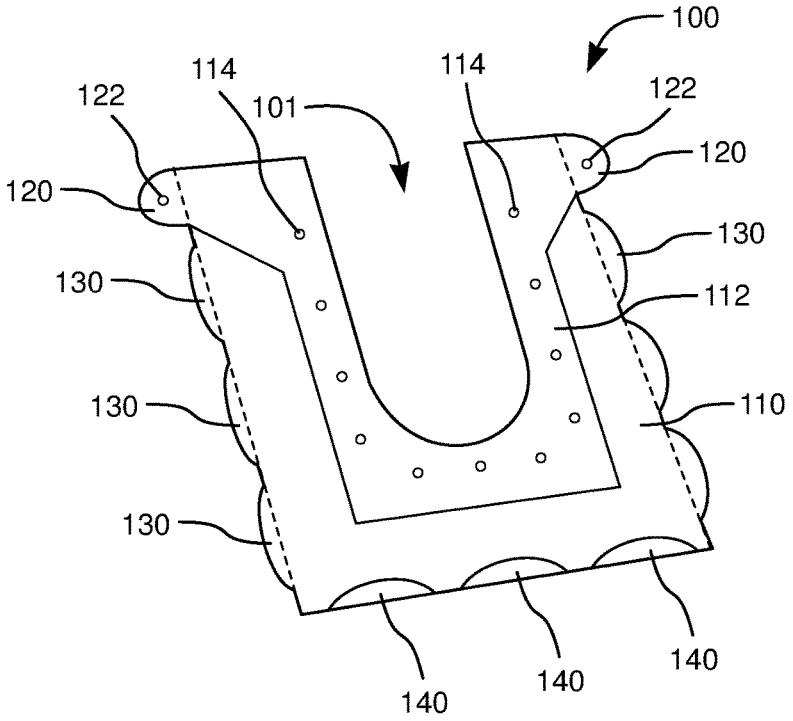
FIG. 1 is a perspective view of a flashing clip.

A flashing clip for securement and weatherproofing of a pipe flashing unit is disclosed. The flashing clip includes a base type tray with an opening and tailored to a flashing unit so that the flashing clip is permanently attachable to a roof and the pipe flashing unit is secured in position within the base tray via foldable clips.

For residential homes, the main purpose of a roof is to protect against weather, and particularly against water. Flashing components are utilized at edges such as perimeters, penetrations, walls, expansion joints, valleys, drains, and any other interruption or termination of the roof's protective covering. For example, membrane base flashing covers the edge of the field membrane such as horizontal-to-vertical intersections where it extends up the vertical surface. Cap flashings or counterflashings shield the upper edges of the base flashing.

Roof flashing is used at discontinuities in the roof or where objects protrude from the roof and is also used in dips or valleys where runoff concentrates. In such instances, the roof flashing serves to deflect water away from the various seams or joints. Roof flashing as an engineering technique has been known for hundreds of years and depends almost entirely on gravity. Correct installation of the flashing allows gravity to work with the flashing material to direct the water onto regular roofing materials and then to the ground or other drainage. Specifically, roof flashing is commonly utilized around chimneys, air vents, plumbing vent stacks, and any other items that are likely to project from residential roofs.

Flashing, or weatherproofing, traditionally refers to the practice of utilizing thin or sheet type pieces of metal to prevent the flow of water into or through the joints of a structure. Flashing can be concealed or exposed according to the particular use or situation. Roofs that include pipes extending through the roof for various reasons often utilize exposed flashing of a sheet metal type that is nailed or otherwise fastened to the roof, either under or above the shingles. It is preferable for any type flashing to be installed prior to the shingles so that the later installed shingles can divert water away from any nails or fasteners and prevent leaks.

Repairs, however, often complicate installation matters as shingles must be at least partially removed to effect repair. Preventing leaks during and after repairs inevitably becomes more complex due to the use of nails and/or caulking.

The present disclosure provides for securing a pipe flashing unit in place without the need for caulking or other sealants. A pipe flashing unit is secured within the flashing clip via foldable clips so that nails or fasteners utilized to secure the flashing clip in place on the roof are covered by the pipe flashing unit. Exposed nails are eliminated so that no water or rain reaches the nails under the pipe flashing unit. Shingles finish the securement of the pipe flashing unit by covering its upper portion.

Figure 2:
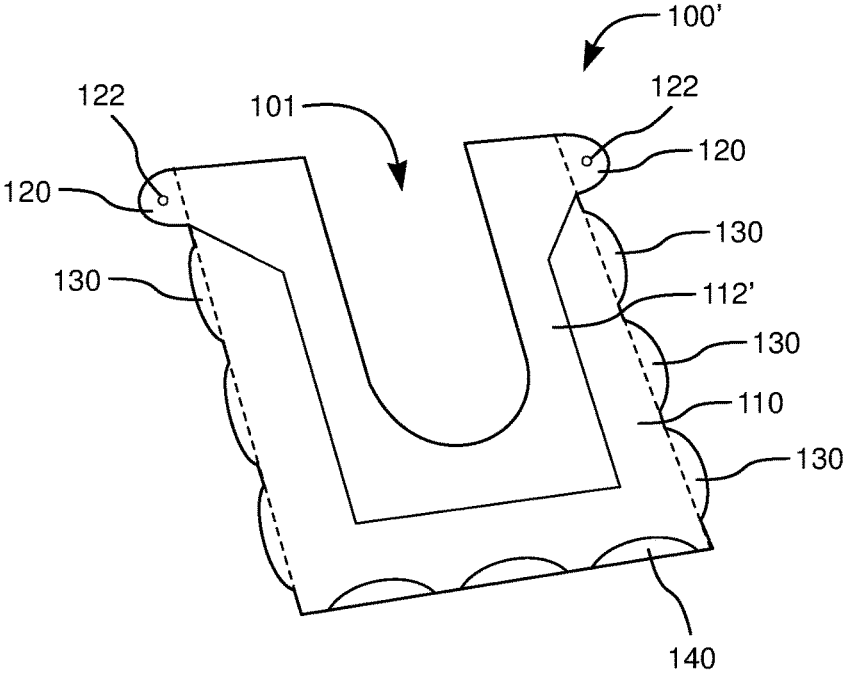
FIG. 2 is a perspective view of an alternative flashing clip.
Figure 3:
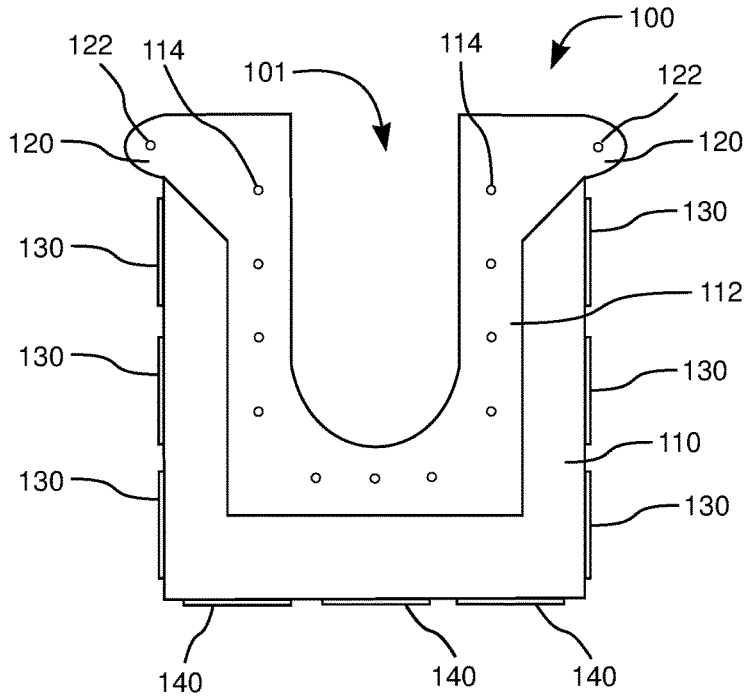
FIG. 3 is a front view of the flashing clip of FIG. 1.
Figure 4:
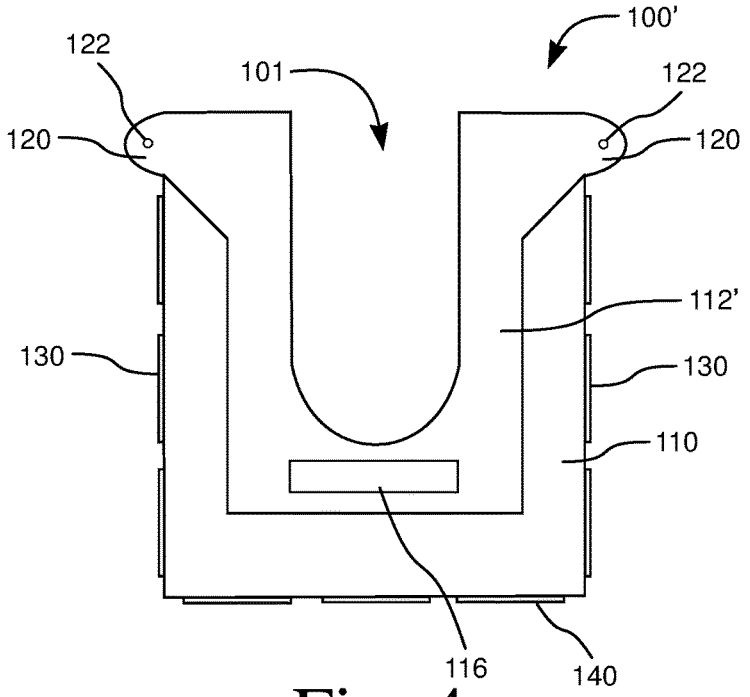
FIG. 4 is a front view of the alternative flashing clip of FIG. 2.
Figure 5:
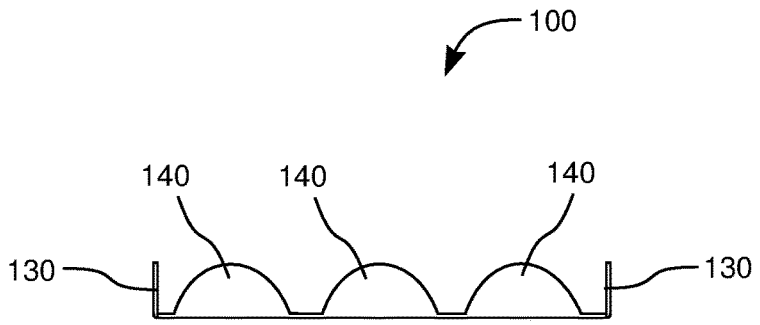
FIG. 5 is an end view of the flashing clip.
Figure 6:
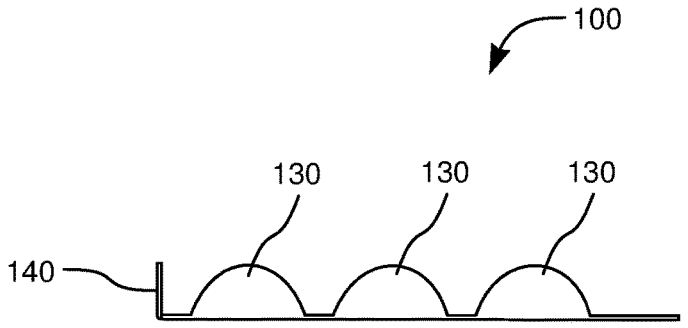
FIG. 6 is a side view of the flashing clip.

FIG. 1 is a perspective view of a flashing clip 100 for securing and weatherproofing of a pipe flashing unit. FIG. 2 is a perspective view of an alternative flashing clip 100'. FIG. 3 is a front view of the flashing clip 100 and FIG. 4 is a front view of the alternative flashing clip 100'. FIG. 5 is an end view of the flashing clip 100 and FIG. 6 is a side view of the flashing clip 100. The flashing clip 100 is a metal base plate 110 having an aperture (or elongated opening) 101, a pair of tabs 120, a number of foldable side clips 130, and a number of foldable end clips 140. In one embodiment, the alternative flashing clip 100' also includes a label 116 for identifying the fastening zone 112'. In the illustrated embodiment, the metal base plate 110 is rectangular in shape. It should be noted that the metal base plate 110 may take on various shapes, according to design choice and according to the desired shape for securing a particular flashing unit.

In various embodiments, the base plate 110 is made from aluminum, sheet metal, stainless steel, galvanized steel, or any other suitable material that is foldable and capable of being formed into a thin or flat sheet, and having weather resistant capabilities against rust and decay.

In the illustrated embodiment, the aperture 101 is an elongated opening having a width extending between opposing edges of the base plate 110. The width of the aperture 101 is at least as large as the diameter of a pipe or other protrusion such as customarily extends from a roof, around which the flashing clip 100 is fitted. The aperture 101 extends from one end of the base plate 110 toward the end clips 140 at the opposite end of the base plate 110. The length of the aperture 101 typically extends for half the length of the base plate 100 or more.

A pair of opposing tabs 120 extend outward from opposing edges of the base plate 110 near the end opposite the end clips 140. In the illustrated embodiment, one edge of each tab 120 aligns with the end of the base plate 110 opposite the end clips 140. Each tab 120 includes a fastener opening 122 for attaching the flashing clip 100 to the roof and securing the flashing clip 100 in position during installation of a pipe flashing unit such as an elastomeric boot. In the illustrated embodiment, the fastener opening 122 is a small hole having diameter sufficient for nails, wood screws, or other similar type fasteners as is known in the art. In a typical embodiment, an installer (or roofer) would drive a nail through each fastener opening 122 and into the roof surface to attach the flashing clip 100 permanently to the roof. Further details regarding installation of the flashing clip 100 are provided below.

The base plate 110 includes an attachment zone or nail zone 112 for securely attaching the flashing clip 100 in place according to the particular pipe flashing unit dimensions. In one embodiment, as illustrated in FIG. 1 and FIG. 3, the nail zone 112 includes a series of fastener holes 114. The fastener holes 114 are small holes having diameter sufficient for nails, wood screws, or similar type fasteners as is known in the art. The series of fastener holes 114 extend along either side of the aperture 101 and also at the end of the aperture 101 between the aperture 101 and the end clips 140 of the flashing clip 100.

During one typical installation, the installer places the flashing clip 100 around a pipe extending from the roof to determine an approximate position. Next, a pipe flashing unit or boot is positioned in place within the side clips 130 and end clips 140 of the flashing clip 100. Once the pipe flashing unit is in position and provides the correct location for the flashing clip 100, fasteners are utilized at each fastener opening 122 to attach the flashing clip 100 in the marked as correct position. After determining the correct position of the flashing clip 100 and securing in place via fasteners or nails through the fastener openings 122, the pipe flashing unit is temporarily removed from position so that the installer can drive a number of nails through at least some of the fastener holes 114 to permanently secure the flashing clip 100 in place. In any particular embodiment that includes fastener holes 114, the nail zone 112 includes at least enough fastener holes to provide for any particular required number of fasteners according to local codes or ordinances.

It should be noted also that the flashing clip 100 does not depend on and is not concerned with the angle or slope of a particular roof. Since the pipe flashing unit is secured separately to the flashing clip 100, then the angle or slope of the pipe flashing unit and the corresponding roof does not affect the usage of the flashing clip 100.

In the illustrated embodiment of FIG. 2, the nail zone 112' of the alternative pipe flashing clip 100' does not include fastener holes, but rather allows for the installer to create their own holes whether by nailing through the nail zone 112' of the base plate 110 or by pre-drilling holes at selected locations within the nail zone 112'. Such an embodiment provides complete flexibility for the installer to locate fastener holes in a suitable location according to preference or to other particular concerns that may arise during a particular installation.

The side clips 130 extend from opposing edges generally parallel to the aperture 101. The end clips 140 extend from the end opposite the aperture 101. The side clips 130 and the end clips 140 together are foldable to secure a pipe flashing unit in place to the base plate 110 within the flashing clip 100. Once the pipe flashing unit is secure in place with the side clips 130 and end clips 140 folded closed, the nails (or other type fasteners) are therefore covered. Shingles may then be positioned and/or replaced to cover the combination of the pipe flashing unit and flashing clip 100 so that there is no need for caulking the nails (or fasteners).

FIG. 7 through FIG. 13 together provide a perspective view illustration for securing a flashing clip 100 and a corresponding pipe flashing unit 40 into position around a pipe 20 extending above a roof 10.

Figure 7:
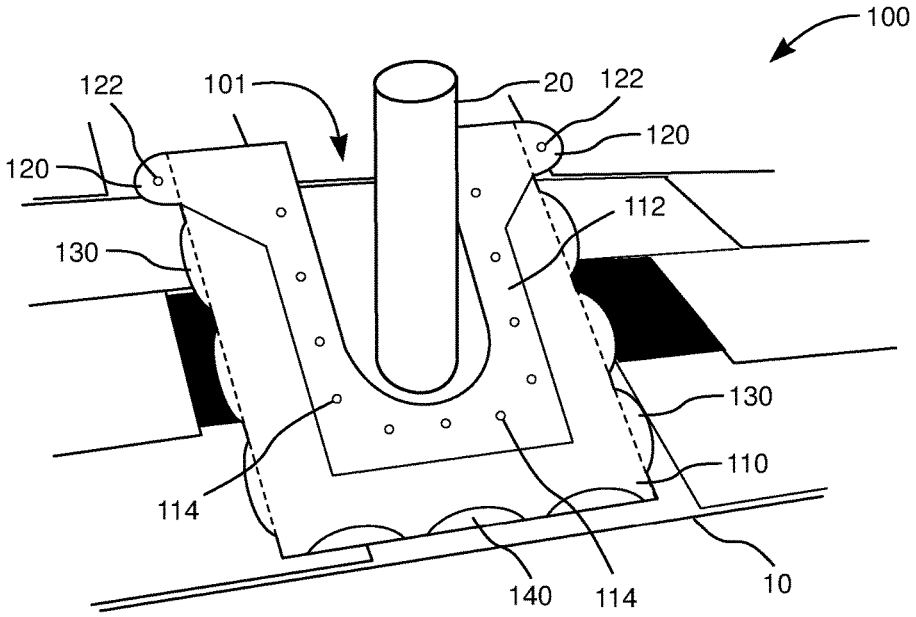
FIG. 7 is a perspective view of the flashing clip positioned on a roof.

FIG. 7 is a perspective view of the flashing clip 100 positioned on a roof 10. The flashing clip 100 is positioned near and around a pipe 20 extending from the roof 10. This initial placement of the flashing clip 100 serves for determining an approximate position relative to the pipe 10. The flashing clip 100 is not typically nailed or fastened in place during this initial placement since some additional movement or shifting is still likely. Any fastening during this phase would most likely be merely temporary. It can be seen in the illustration that no fasteners are present in either the fastener openings 122 or the fastener holes 114 at this juncture of the installation.

Figure 8:
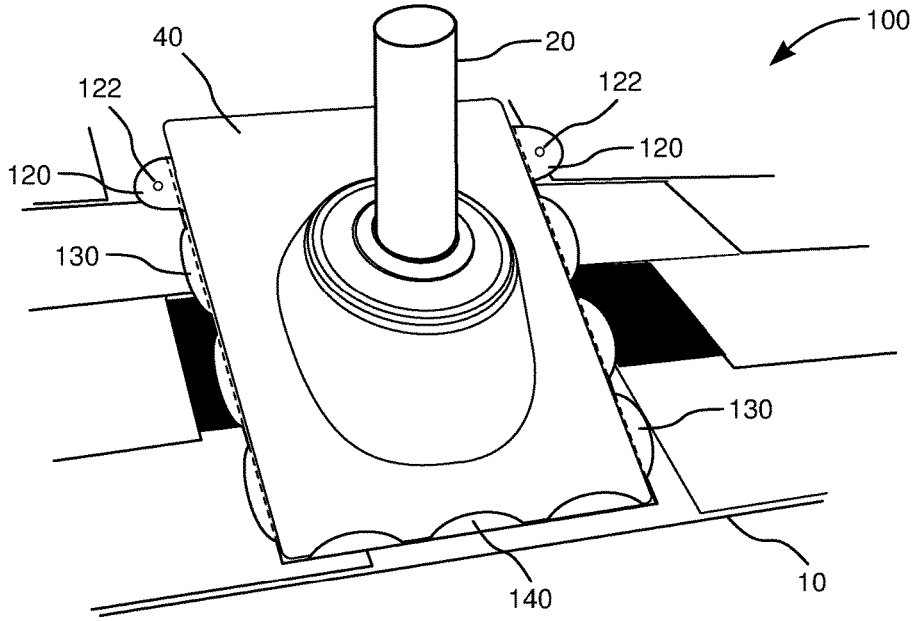
FIG. 8 is a perspective view of the flashing clip positioned on a roof with a pipe flashing in place.

FIG. 8 is a perspective view of the flashing clip 100 positioned on a roof 10 with a pipe flashing unit 40 in position around and over the pipe 20 and upon the base plate 110. A pipe flashing unit 40 as in the illustrated embodiment is sometimes referred to as a "boot." At this point during the installation, no fasteners have yet been permanently positioned or installed. The side clips 130 and end clips 140 have only been folded, if any, enough to prevent sideways motion or movement of the pipe flashing unit 40, but not enough to permanently secure the pipe flashing unit 40 in place.

It should also be noted that the flashing clip 100 provides for securing any type flashing that extends from a roof or similar surface. For example, the flashing clip 100 provides for securing a pipe flashing unit as described below, but is not limited to securing merely pipe flashing. The flashing clip 100 also provides for securing a furnace flue flashing, power vents, and turtle back vents, among others. Additionally, the universal flashing clips 200 and the alternative universal flashing clips 300 described below may be used in conjunction with or separately from the flashing clip 100, to provide for securement of ridge vents, continuous wall flashing, and apron flashing, as well as any location that includes a unique or unusual shape for securing roofs, walls, doors, windows, and combination joints or seams, where water flow or entrance can be a concern.

Once the correct position for the pipe flashing unit 40 has been determined so that the correct location of the flashing clip 100 is known, fasteners are utilized at each fastener opening 122 to attach the flashing clip 100 in the marked as correct position. The installer drives a nail through each fastener opening 122 and into the roof surface to attach the flashing clip 100 permanently to the roof 10.

Figure 9:
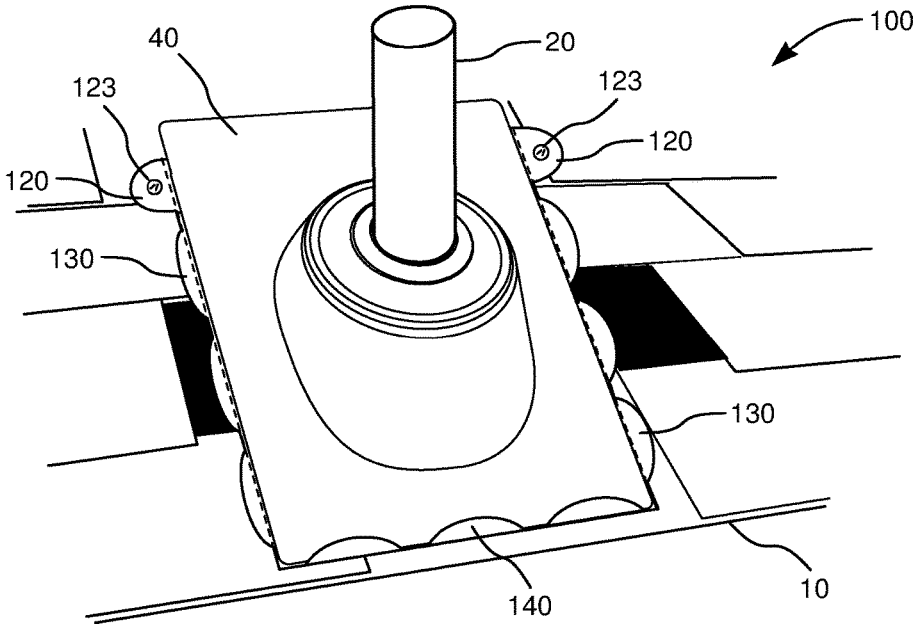
FIG. 9 is a perspective view of the flashing clip positioned on a roof with a pipe flashing and tabs secured in place.

FIG. 9 illustrates a perspective view of the flashing clip 100 positioned on the roof 10 with the side tabs 120 nailed in place while the pipe flashing unit 40 is still situated within the base plate 100 of the flashing clip 100. It should be noted that the side clips 130 and end clips 140 have not been permanently folded at this point of the installation. Nailing the tabs 120 provides for securing the flashing clip 100 in its permanent position while the underlying fasteners have not yet been installed for a more secure fastening of the flashing clip 100.

Figure 10:
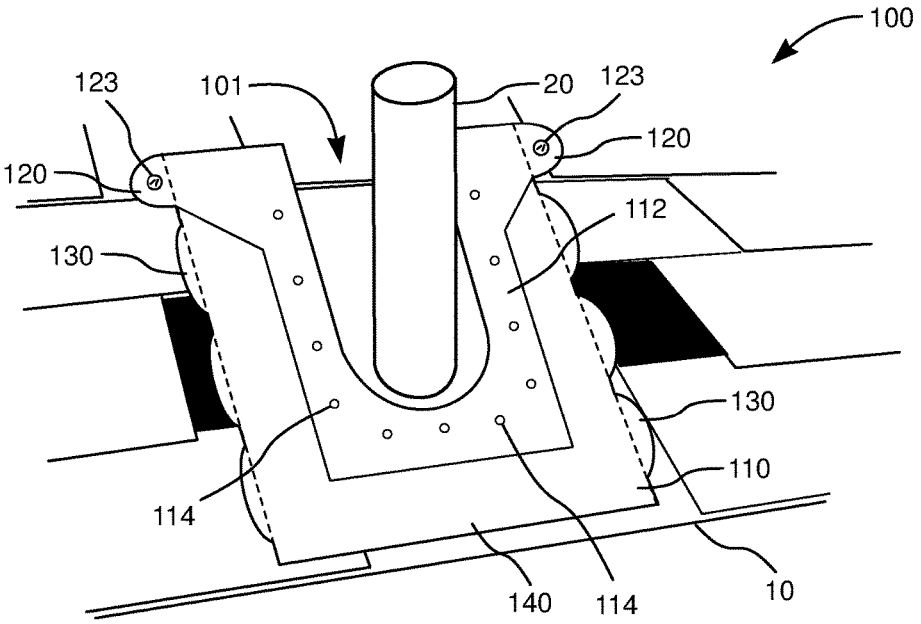
FIG. 10 is a perspective view of the flashing clip positioned on a roof with tabs secured in place.

FIG. 10 is a perspective view of the flashing clip 100 positioned on a roof with tabs 120 nailed in place. The pipe flashing unit 40 has been removed from the base plate 100 so that additional nails, or other fasteners, may be utilized to permanently secure the flashing clip 100 to the roof 10. It should be noted that any or all of the fastener holes 114 may be utilized for the respective nails to secure the flashing clip 100.

Figure 11:
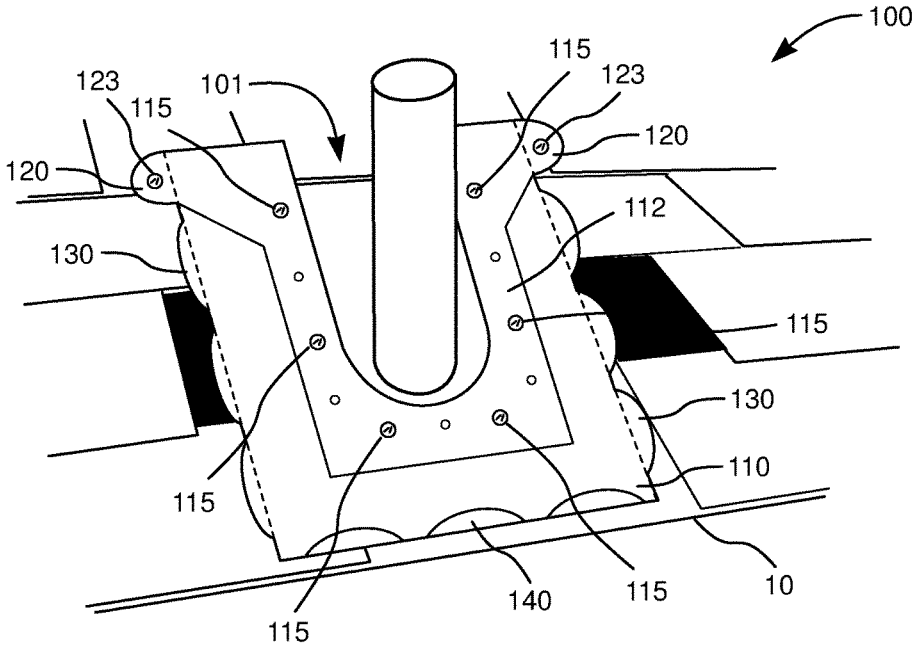
FIG. 11 is a perspective view of the flashing clip secured in position on a roof.

FIG. 11 is a perspective view of the flashing clip 100 nailed in position on a roof 10. As in FIG. 10, the pipe flashing unit 40 has been removed after securing the tabs 120 with nails or other fasteners. At this point in the installation, nails 115, or fasteners, are utilized to permanently secure the flashing clip 100 in place. In the illustrated embodiment, six nail heads 115 are shown at the locations where the nails have been driven. In this illustrated embodiment, the remaining fastener holes 114 are not used. The number of fastener holes 114 used in any particular situation varies according to preference, necessity, or in some cases local codes and/or ordinances.

Figure 12:
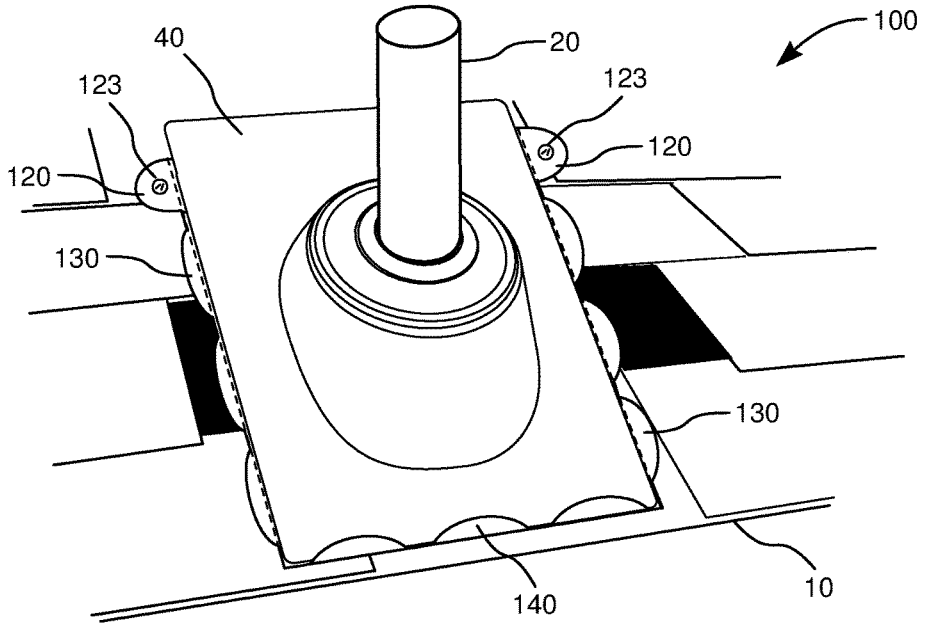
FIG. 12 is a perspective view of the flashing clip secured in position on a roof and a pipe flashing in place.

FIG. 12 is a perspective view of the flashing clip 10 nailed in position on a roof 10 and a pipe flashing unit 40 in position on the base plate 110 of the flashing clip 100. After permanently securing the flashing clip 100 with nails, the pipe flashing unit 40 is placed at its correct location within the flashing clip 100. After placing the pipe flashing unit 40 within the flashing clip 100, the side clips 130 and end clips 140 are folded over the edges of the pipe flashing unit 40 to secure it in place.

Figure 13:
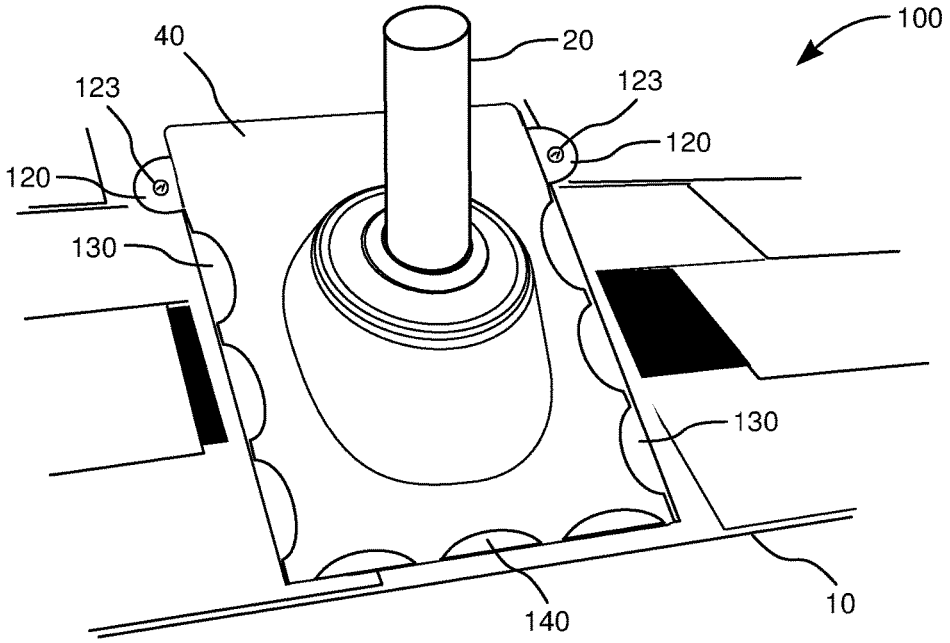
FIG. 13 is a perspective view of the flashing clip secured in position on a roof with side clips and end clips folded over the edges of a pipe flashing unit to secure it in place.

FIG. 13 is a perspective view illustrating the flashing clip 100 nailed in position on a roof 10 with the side clips 130 and the end clips 140 folded over the edges of the pipe flashing unit 40 to secure it in place within the flashing clip 100. The side clips 130 and the end clips 140 together are foldable to secure the pipe flashing unit 40 in place to the base plate 110 within the flashing clip 100. Once the pipe flashing unit 40 has been secured in place via folding the side clips 130 and end clips 140 over its edges, the nails (or any other type fasteners) are therefore covered. Shingles may then be positioned and/or replaced to cover the combination of the pipe flashing unit 40 and flashing clip 100 so that there is no need for caulking the nails (or fasteners). The shingles cover the upper portion of the pipe flashing unit 40 so that any rainwater runoff does not reach the nails (fasteners) and the installation does not leak.

During and after installation, the flashing clip 100 does not depend on and is not concerned with the particular angle or slope of the roof 10. Since the pipe flashing unit 40 is secured separately to the flashing clip 100, then the angle or slope of the pipe flashing unit 40 and the corresponding roof 10 does not affect the usage or installation concerns of the flashing clip 100. Virtually any roof slope is protectable via simply positioning the flashing clip 100 in place along with the pipe flashing unit 40, securing the tabs 120, temporarily removing the pipe flashing unit 40 to permanently secure the flashing clip 100, reinserting the pipe flashing unit 40, and permanently securing the pipe flashing unit 40 via folding the side clips 130 and end clips 140. From there it is a simple matter of replacing the shingles to provide a permanent and weather secure installation to protect from leaks.

As is evidenced in the description above, utilizing the flashing clip 100 in concert with a pipe flashing unit 40 eliminates the need for caulking, whether for nails (or fasteners) or waterflow, while also accounting for varying roof slopes.

FIG. 14-A is a perspective view of a universal flashing clip 200, FIG. 14-B is a side view of a universal flashing clip 200, and FIG. 14-C is a top view of a universal flashing clip 200. The universal flashing clip 200 includes a narrow base plate 210, half clips 220, side clips 230, and fastener slots 212. A combination of universal flashing clips 200 may utilized in concert to form or extend a weather protection boundary around pipes or other locations. A particular combination of universal flashing clips 200 can be assembled together to form a base location for a particular pipe flashing unit or other type flashing device, thus creating a barrier to water reaching the fasteners and protecting against leaks.

FIG. 15-A is a perspective view of an alternative universal flashing clip 300, FIG. 15-B is a side view of an alternative universal flashing clip 300, and FIG. 15-C is a top view of an alternative universal flashing clip 300. Similar to the universal flashing clip 200 described above, the alternative universal flashing clip 300 includes a narrow base plate 310, side clips 320, and fastener holes 312. A combination of alternative universal flashing clips 300, and/or the universal flashing clips 200, may be utilized in concert to form or extend a weather protection boundary around pipes or other locations. A particular combination of alternative universal pipe flashing 300, and/or the universal flashing clips 200, can be assembled together to form a base location for a particular pipe flashing unit or other type flashing device, thus creating a barrier to water reaching the fasteners and protecting against leaks.

Additionally, it should be noted that many base shapes can be utilized as alternative flashing clips. For example, an alternative flashing clip could be triangular, or even be a divided triangle, in its base shape. The concept remains that a base shape can be utilized along with foldable edge clips and/or foldable end clips to secure a pipe flashing or other type flashing unit. Again, the basis of an alternative flashing clip includes a base plate, side clips and/or end clips, and fastener holes, arranged in a manner that provides for attachment to the roof, positioning of the flashing unit, and folding the clips to secure the flashing unit at its proper location around the roof protrusion.

The universal flashing clips 200, the alternative universal flashing clips 300, and/or other alternative shaped flashing clips (not pictured) as described above, provide an alternative solution for protecting against leaks while utilizing pipe flashing units for which a particular fitted flashing clip does not exist.

Figure 16:
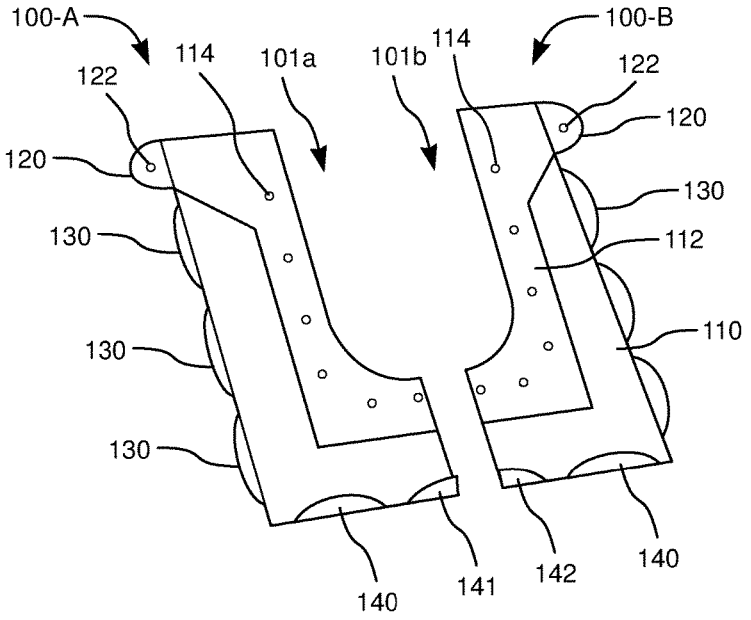
FIG. 16 is a perspective view of a multi-piece flashing clip.
Figure 17:
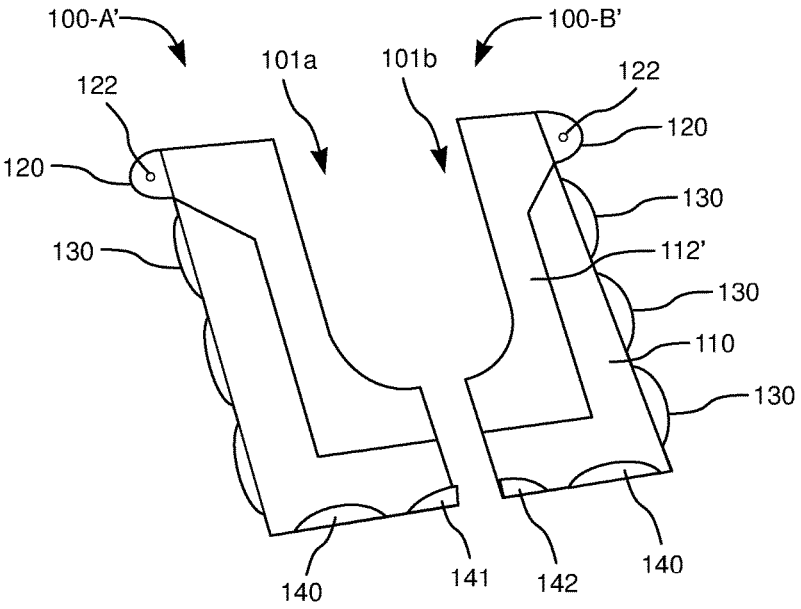
FIG. 17 is a perspective view of an alternative multi-piece flashing clip.
Figure 18:
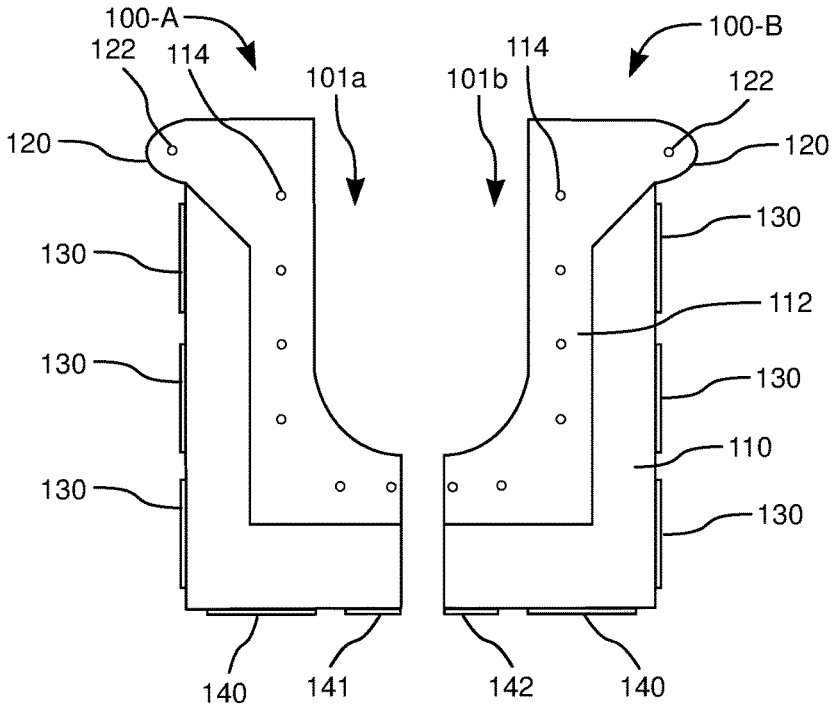
FIG. 18 is a front view of the multi-piece flashing clip of FIG. 16.
Figure 19:
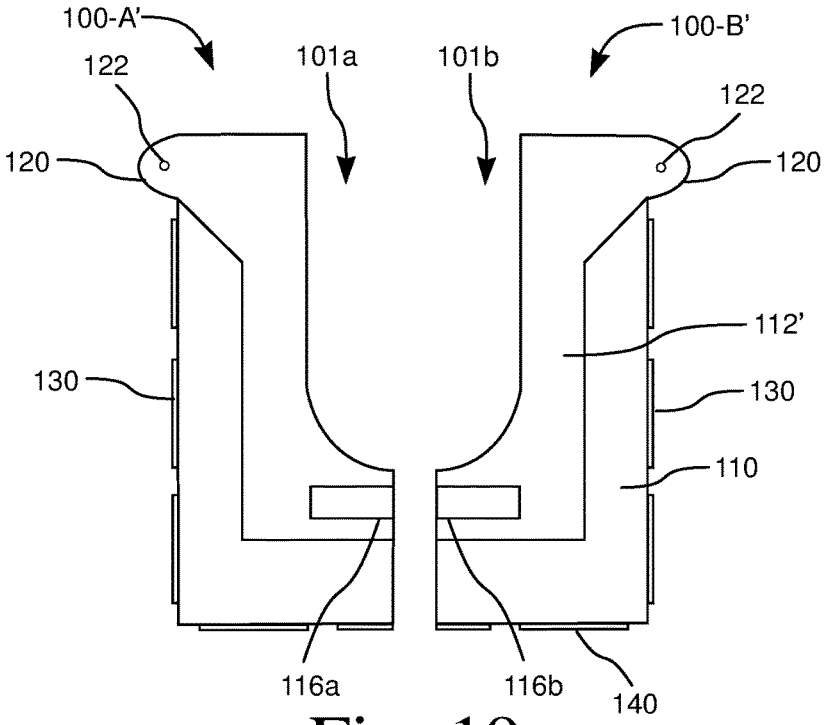
FIG. 19 is a front view of the alternative multi-piece flashing clip of FIG. 17.
Figure 20:
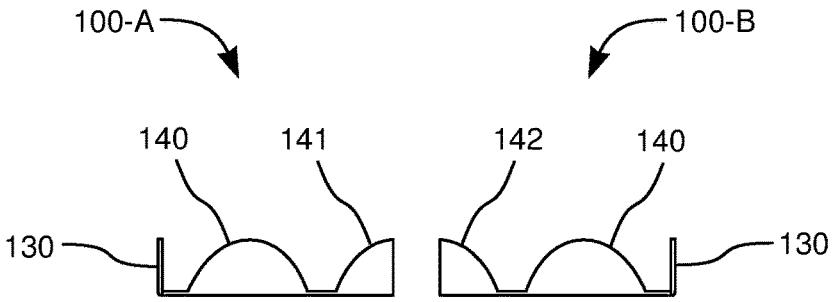
FIG. 20 is an end view of the multi-piece flashing clip.

FIG. 16 is a perspective view of a multi-piece flashing clip 100-A, 100-B for securing and weatherproofing of a pipe flashing unit. FIG. 17 is a perspective view of an alternative multi-piece flashing clip 100-A', 100-B'. FIG. 18 is a front view of the multi-piece flashing clip 100-A, 100-B and FIG. 19 is a front view of the alternative multi-piece flashing clip 100-A', 100-B'. FIG. 20 is an end view of the multi-piece flashing clip 100-A, 100-B. The multi-piece flashing clip 100-A, 100-B includes two metal base plates 110*a*, 110*b* respectively having an aperture 101*a*, 101*b*, a tab 120 on each, a number of foldable side clips 130, and a number of foldable end clips 140. In the illustrated embodiment, each metal base plate 110*a*, 110*b* further includes a foldable end half-clip 141, 142 respectively adjacent the inner edge of the respective metal base plate 110*a*, 110*b*. In one embodiment, the alternative multi-piece flashing clip 100-A', 100-B' also includes labels 116*a*, 116*b* respectively for identifying the respective fastening zone 112'.

In various embodiments, each metal base plate 110 is made from aluminum, sheet metal, stainless steel, galvanized steel, or any other suitable material that is foldable and capable of being formed into a thin sheet, and having weather resistant capabilities against rust and decay.

A pair of opposing tabs 120 extend outward from opposing outer edges of each metal base plate 110 near the end opposite the respective end clips 140. In the illustrated embodiment, one edge of each tab 120 aligns with the end of the respective metal base plate 110 opposite the end clips 140. Each tab 120 includes a fastener opening 122 for attaching the multi-piece flashing clip 100-A, 100-B to the roof and securing the multi-piece flashing clip 100-A, 100-B in position during installation of a pipe flashing unit such as an elastomeric boot. In the illustrated embodiment, each fastener opening 122 is a small hole having diameter sufficient for nails, wood screws, or other similar type fasteners as is known in the art. In one typical embodiment, an installer (or roofer) would drive a nail through each fastener opening 122 and into the roof surface to attach the multi-piece flashing clip 100-A, 100-B permanently to the roof. Further details regarding installation of the multi-piece flashing clip 100-A, 100-B are provided below.

The metal base plate 110 includes an attachment zone or nail zone 112 for securely attaching the multi-piece flashing clip 100-A, 100-B in place according to the particular pipe flashing unit dimensions. In one embodiment, as illustrated in FIG. 16 and FIG. 17, the nail zone 112 includes a series of fastener holes 114. The fastener holes 114 are small holes having diameter sufficient for nails, wood screws, or similar type fasteners as is known in the art. The series of fastener holes 114 extend along either side of the respective aperture 101*a*, 101*b* between the metal base plates 110 and also at the end of each aperture 101*a*, 101*b* situated between the respective aperture 101*a*, 101*b* and the end clips 140 of the multi-piece flashing clip 100-A, 100-B.

During one typical installation, the installer places the multi-piece flashing clip 100-A, 100-B around a pipe extending from the roof to determine an approximate position. Next, a pipe flashing unit or boot is positioned in place within the side clips 130 and end clips 140 of the multi-piece flashing clip 100-A, 100-B. Once the pipe flashing unit is in position and provides the correct location for the multi-piece flashing clip 100-A, 100-B, fasteners are utilized at each fastener opening 122 to attach the multi-piece flashing clip 100-A, 100-B in the marked as correct position. After determining the correct position of the flashing clip 100 and securing in place via fasteners or nails through the fastener openings 122, the pipe flashing unit is temporarily removed from position so that the installer can secure the multi-piece flashing clip 100-A, 100-B via nails or other fasteners through at least some of the fastener holes 114 to permanently secure the multi-piece flashing clip 100-A, 100-B in place. In any particular embodiment that includes fastener holes 114, the nail zone 112 includes at least enough fastener holes 114 to provide for any particular required number of fasteners according to local codes or ordinances.

It should be noted also that the multi-piece flashing clip 100-A, 100-B does not depend on and is not concerned with the angle or slope of a particular roof. Since the pipe flashing unit is secured separately to the multi-piece flashing clip 100-A, 100-B, then the angle or slope of the pipe flashing unit and the corresponding roof does not affect the usage of the multi-piece flashing clip 100-A, 100-B.

In the illustrated embodiment of FIG. 17, the nail zone 112' of the alternative pipe multi-piece flashing clip 100-A', 100-B' does not include fastener holes, but rather allows for the installer to create their own holes whether by nailing through the nail zone 112' of each metal base plates 110 or by pre-drilling holes at selected locations within the nail zone 112'. Such an embodiment provides complete flexibility for the installer to locate fastener holes in a suitable location according to preference or to other particular concerns that may arise during a particular installation.

The side clips 130 extend from opposing edges generally parallel to the aperture 101. The end clips 140 and/or end half-clips 141, 142 extend from the end opposite the aperture 101. The side clips 130 and the end clips 140 and/or end half-clips 141, 142 together are foldable to secure a pipe flashing unit in place to the metal base plates 110 within the multi-piece flashing clip 100-A, 100-B. Once the pipe flashing unit is secure in place with the side clips 130 and the end clips 140 and/or end half-clips 141, 142 folded closed, the nails (or other type fasteners) are therefore covered. Shingles may then be positioned and/or replaced to cover the combination of the pipe flashing unit and multi-piece flashing clip 100-A, 100-B so that there is no need for caulking the nails (or fasteners).

Figure 21:
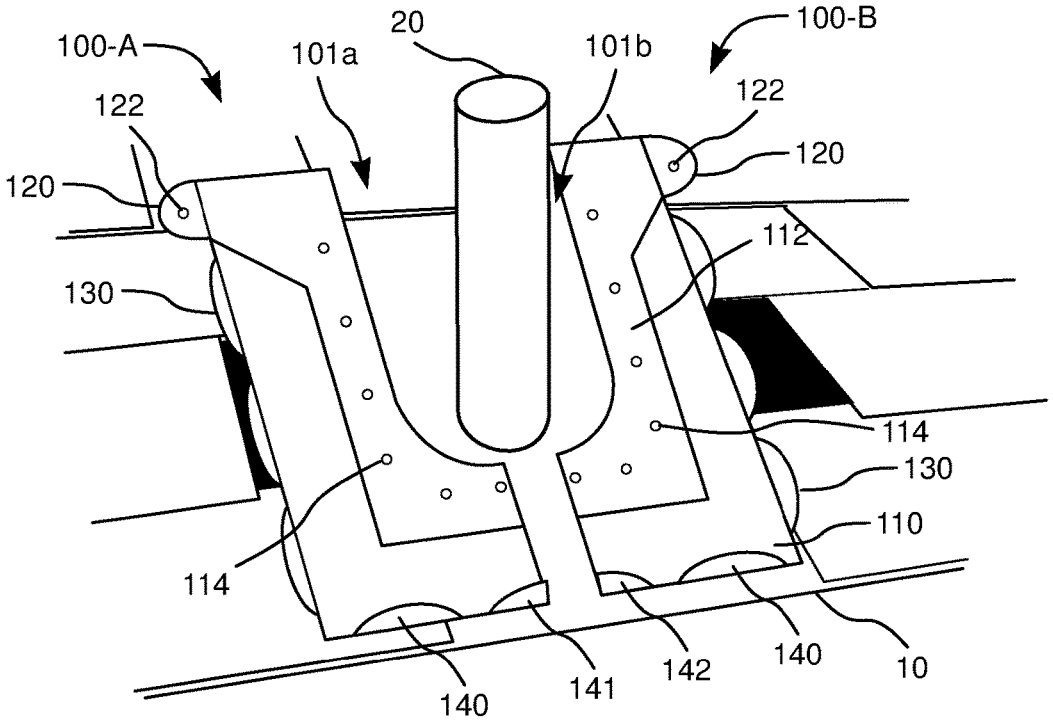
FIG. 21 is a perspective view of a multi-piece flashing clip positioned on a roof in preparation for a large pipe flashing.

FIG. 21 is a perspective view of the multi-piece flashing clip 100-A, 100-B positioned on a roof 10. The multi-piece flashing clip 100-A, 100-B is situated with the metal base plates 110 separated to accommodate a large pipe flashing unit, and is positioned near and around a pipe 20 extending from the roof 10. The separate metal base plates 110 provide for adjustability and flexibility in utilizing the multi-piece flashing clip 100-A, 100-B for different size pipe flashing units 40 that may be wider than standard one-size only flashing clips.

The initial placement of the multi-piece flashing clip 100-A, 100-B serves for determining an approximate position relative to the pipe 10. The multi-piece flashing clip 100-A, 100-B is not typically nailed or fastened in place during this initial placement since some additional movement or shifting is still likely. Any fastening during this phase would most likely be merely temporary. It can be seen in the illustration that no fasteners are present in either the fastener openings 122 or the fastener holes 114 at this juncture of the installation.

Figure 22:
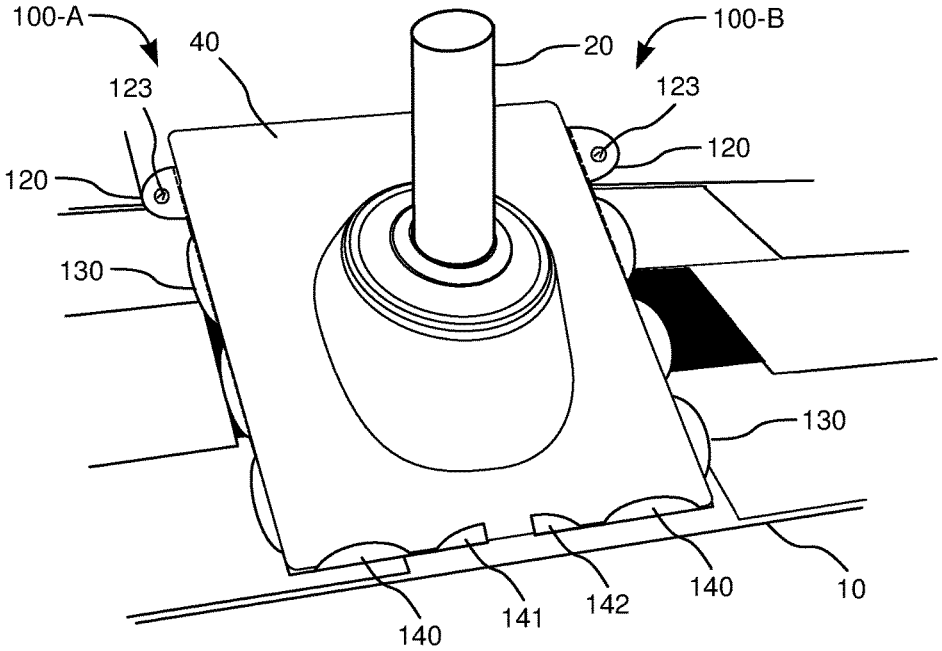
FIG. 22 is a perspective view of the multi-piece flashing clip positioned on a roof with a large pipe flashing in place.

FIG. 22 is a perspective view of the multi-piece flashing clip 100-A, 100-B positioned on a roof 10 with a pipe flashing unit 40 in position around and over the pipe 20 and upon the metal base plates 110. A pipe flashing unit 40 as in the illustrated embodiment is sometimes referred to as a "boot." At this point during the installation, no fasteners have yet been permanently positioned or installed. The side clips 130 and end clips 140 and/or end half-clips 141, 142 have only been folded, if any, enough to prevent sideways motion or movement of the pipe flashing unit 40, but not enough to permanently secure the pipe flashing unit 40 in place.

It should also be noted that the multi-piece flashing clip 100-A, 100-B provides for securing any type flashing that extends from a roof or similar surface. For example, the multi-piece flashing clip 100-A, 100-B provides for securing a pipe flashing unit as described below, but is not limited to securing merely pipe flashing. The multi-piece flashing clip 100-A, 100-B also provides for securing a furnace flue flashing, power vents, and turtle back vents, among others. Additionally, the universal flashing clips 200 and the alternative universal flashing clips 300 described above may be used in conjunction with or separately from the multi-piece flashing clip 100-A, 100-B, to provide for securement of ridge vents, continuous wall flashing, and apron flashing, as well as any location that includes a unique or unusual shape for securing roofs, walls, doors, windows, and combination joints or seams, where water flow or entrance can be a concern.

Once the correct position for the pipe flashing unit 40 has been determined so that the correct location of the multi-piece flashing clip 100-A, 100-B is known, fasteners are utilized at each fastener opening 122 to attach the multi-piece flashing clip 100-A, 100-B in the marked as correct position. Typically, an installer utilizes nails, wood screws, or similar type fasteners through each fastener opening 122 and into the roof surface to attach the multi-piece flashing clip 100-A, 100-B permanently to the roof 10.

Initially, the multi-piece flashing clip 100-A, 100-B is positioned on the roof 10 with the side tabs 120 secured in place while the pipe flashing unit 40 is still situated within the metal base plates 110 of the multi-piece flashing clip 100-A, 100-B. It should be noted that the side clips 130 and the end clips 140 and/or end half-clips 141, 142 are not typically permanently folded until metal base plates 110 are permanently secured. Nailing the tabs 120 provides for securing metal base plates 110 of the multi-piece flashing clip 100-A, 100-B into their permanent position.

Once the tabs 120 are secured in place, the pipe flashing unit 40 is removed from the metal base plates 110 so that additional nails, or other fasteners, may be utilized to permanently secure the multi-piece flashing clip 100-A, 100-B to the roof 10. It should be noted that any or all of the fastener holes 114 may be utilized for the respective nails, or other fasteners, to secure the metal base plates 110 of the multi-piece flashing clip 100-A, 100-B. The number of fastener holes 114 used in any particular situation varies according to preference, necessity, or in some cases local codes and/or ordinances.

After permanently securing the multi-piece flashing clip 100-A, 100-B with nails, or other fasteners, the pipe flashing unit 40 is placed at its correct location within the multi-piece flashing clip 100-A, 100-B. After placing the pipe flashing unit 40 within the multi-piece flashing clip 100-A, 100-B, the side clips 130 and the end clips 140 and/or end half-clips 141, 142 are folded over the edges of the pipe flashing unit 40 to secure it in place.

Figure 23:
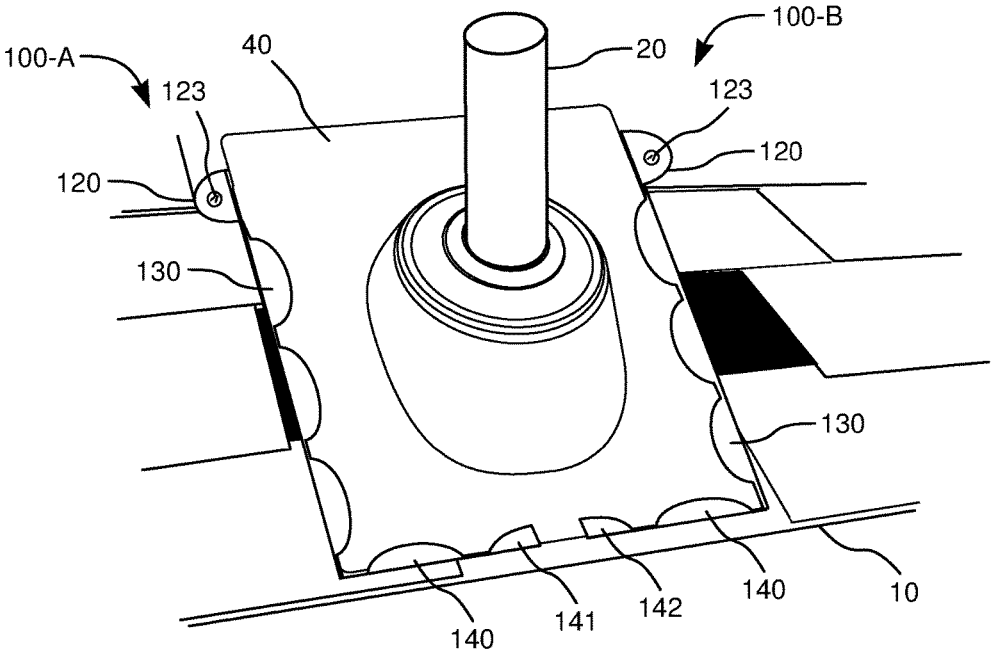
FIG. 23 is a perspective view of the multi-piece flashing clip secured in position on a roof with side clips and end clips folded over the edges of a large pipe flashing unit to secure it in place.

FIG. 23 is a perspective view illustrating the multi-piece flashing clip 100-A, 100-B secured in position on a roof 10 with the side clips 130, the end clips 140, and the end half-clips 141, 142 folded over the edges of the pipe flashing unit 40 to secure it in place. The side clips 130 and the end clips 140 and end half-clips 141, 142 together are foldable to secure the pipe flashing unit 40 in place to the metal base plates 110 within the multi-piece flashing clip 100-A, 100-B. Once the pipe flashing unit 40 has been secured in place via folding the side clips 130 and the end clips 140 and/or end half-clips 141, 142 over its edges, the nails (or any other type fasteners) are therefore covered. Shingles may then be positioned and/or replaced to cover the combination of the pipe flashing unit 40 and multi-piece flashing clip 100-A, 100-B so that there is no need for caulking the nails (or fasteners). The shingles cover the upper portion of the pipe flashing unit 40 so that any rainwater runoff does not reach the nails (fasteners) and the installation does not leak.

During and after installation, the multi-piece flashing clip 100-A, 100-B does not depend on and is not concerned with the particular angle or slope of the roof 10. Since the pipe flashing unit 40 is secured separately to the multi-piece flashing clip 100-A, 100-B, then the angle or slope of the pipe flashing unit 40 and the corresponding roof 10 does not affect the usage or installation concerns of the multi-piece flashing clip 100-A, 100-B. Virtually any roof slope is protectable via simply positioning the multi-piece flashing clip 100-A, 100-B in place along with the pipe flashing unit 40, securing the tabs 120, temporarily removing the pipe flashing unit 40 to permanently secure the multi-piece flashing clip 100-A, 100-B, reinserting the pipe flashing unit 40, and permanently securing the pipe flashing unit 40 via folding the side clips 130 and the end clips 140 and/or end half-clips 141, 142. From there it is a simple matter of replacing the shingles to provide a permanent and weather secure installation to protect from leaks.

Figure 24:
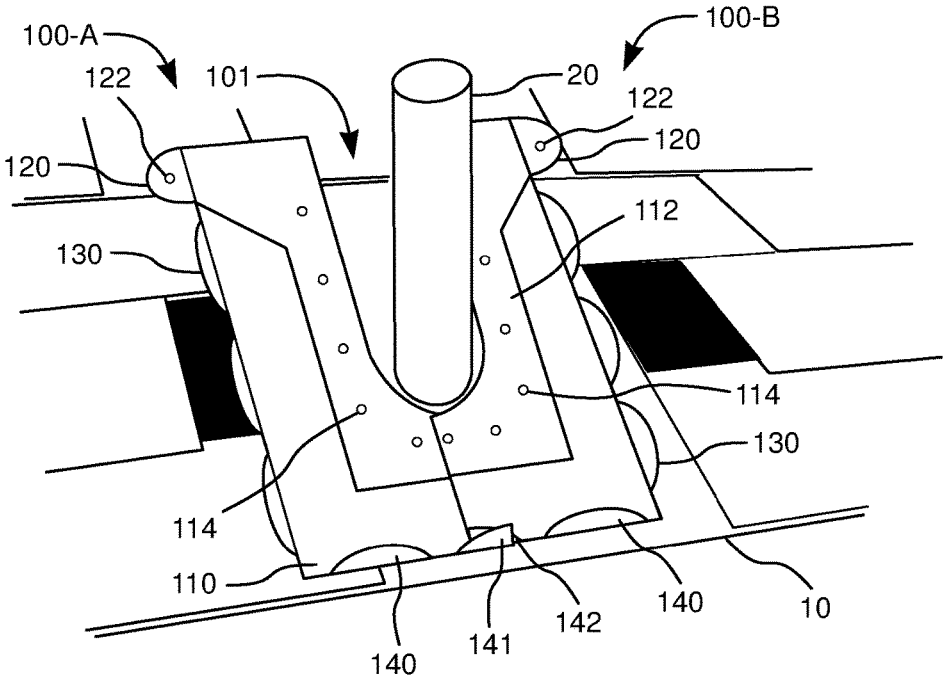
FIG. 24 is a perspective view of a multi-piece flashing clip positioned on a roof in preparation for a small pipe flashing.

FIG. 24 is a perspective view of the multi-piece flashing clip 100-A, 100-B positioned on a roof 10 for installation of a small pipe flashing unit. The multi-piece flashing clip 100-A, 100-B is situated with the metal base plates 110 overlapping each other to accommodate a small pipe flashing unit, and is positioned near and around a pipe 20 extending from the roof 10. The separate metal base plates 110 provide for adjustability and flexibility in utilizing the multi-piece flashing clip 100-A, 100-B for different size pipe flashing units 40 that may be narrower than standard one-size only flashing clips.

As noted above, the initial placement of the multi-piece flashing clip 100-A, 100-B serves for determining an approximate position relative to the pipe 10. The multi-piece flashing clip 100-A, 100-B is not typically nailed or fastened in place during this initial placement since some additional movement or shifting is still likely. Any fastening during this phase would most likely be merely temporary. It can be seen in the illustration that no fasteners are present in either the fastener openings 122 or the fastener holes 114 at this juncture of the installation.

Figure 25:
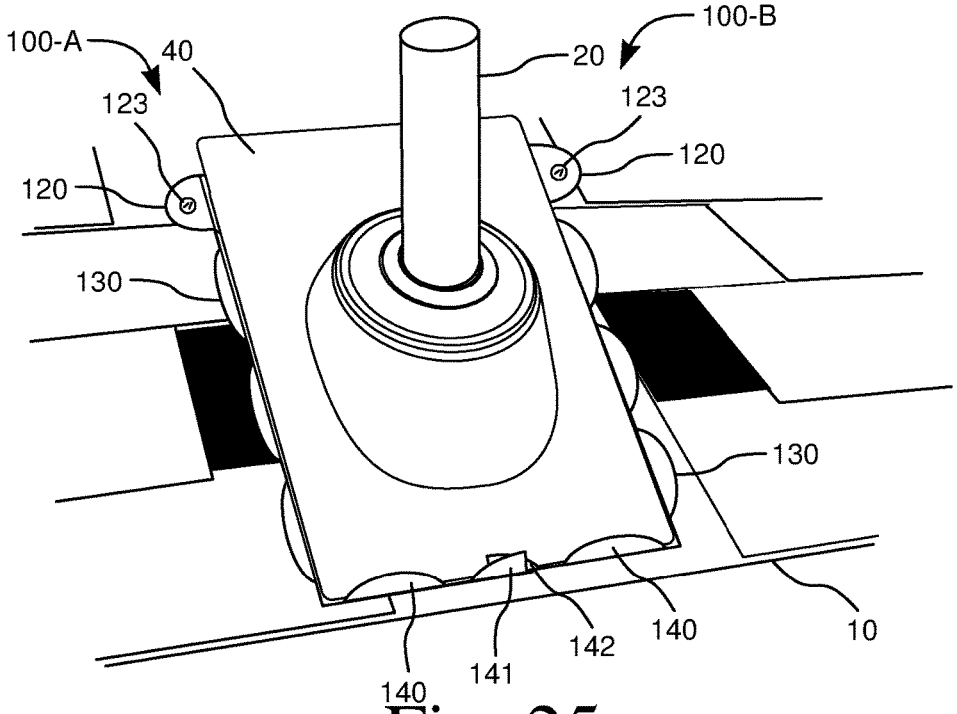
FIG. 25 is a perspective view of the multi-piece flashing clip positioned on a roof with a small pipe flashing in place.

FIG. 25 is a perspective view of the multi-piece flashing clip 100-A, 100-B positioned on a roof 10 with a pipe flashing unit 40 in position around and over the pipe 20 and upon the metal base plates 110. A pipe flashing unit 40 as in the illustrated embodiment is sometimes referred to as a "boot." At this point during the installation, no fasteners have yet been permanently positioned or installed. The side clips 130 and end clips 140 and/or end half-clips 141, 142 have only been folded, if any, enough to prevent sideways motion or movement of the pipe flashing unit 40, but not enough to permanently secure the pipe flashing unit 40 in place.

Once the correct position for the pipe flashing unit 40 has been determined so that the correct location of the overlapping metal base plates 110 of the multi-piece flashing clip 100-A, 100-B is known, fasteners are utilized at each fastener opening 122 to attach the metal base plates 110 in the overlapped and marked as correct position. As noted previously, an installer typically utilizes nails, wood screws, or similar type fasteners through each fastener opening 122 and into the roof surface to attach the multi-piece flashing clip 100-A, 100-B permanently to the roof 10.

Initially, the multi-piece flashing clip 100-A, 100-B is positioned on the roof 10 with the side tabs 120 secured in place while the pipe flashing unit 40 is still situated within the overlapping metal base plates 110 of the multi-piece flashing clip 100-A, 100-B. It should be noted that the side clips 130 and the end clips 140 and/or end half-clips 141, 142 are not typically permanently folded until the overlapping metal base plates 110 are permanently secured. Nailing the tabs 120 provides for securing the overlapping metal base plates 110 of the multi-piece flashing clip 100-A, 100-B into their permanent position.

Once the tabs 120 are secured in place, the pipe flashing unit 40 is removed from the metal base plates 110 so that additional nails, or other fasteners, may be utilized to permanently secure the multi-piece flashing clip 100-A, 100-B to the roof 10. It should be noted that any or all of the fastener holes 114 may be utilized for the respective nails, or other fasteners, to secure the overlapping metal base plates 110 of the multi-piece flashing clip 100-A, 100-B. The number of fastener holes 114 used in any particular situation varies according to preference, necessity, or in some cases local codes and/or ordinances.

After permanently securing the multi-piece flashing clip 100-A, 100-B with nails, or other fasteners, the pipe flashing unit 40 is placed at its correct location within the multi-piece flashing clip 100-A, 100-B. After placing the pipe flashing unit 40 within the multi-piece flashing clip 100-A, 100-B, the side clips 130 and the end clips 140 and/or end half-clips 141, 142 are folded over the edges of the pipe flashing unit 40 to secure it in place.

Figure 26:
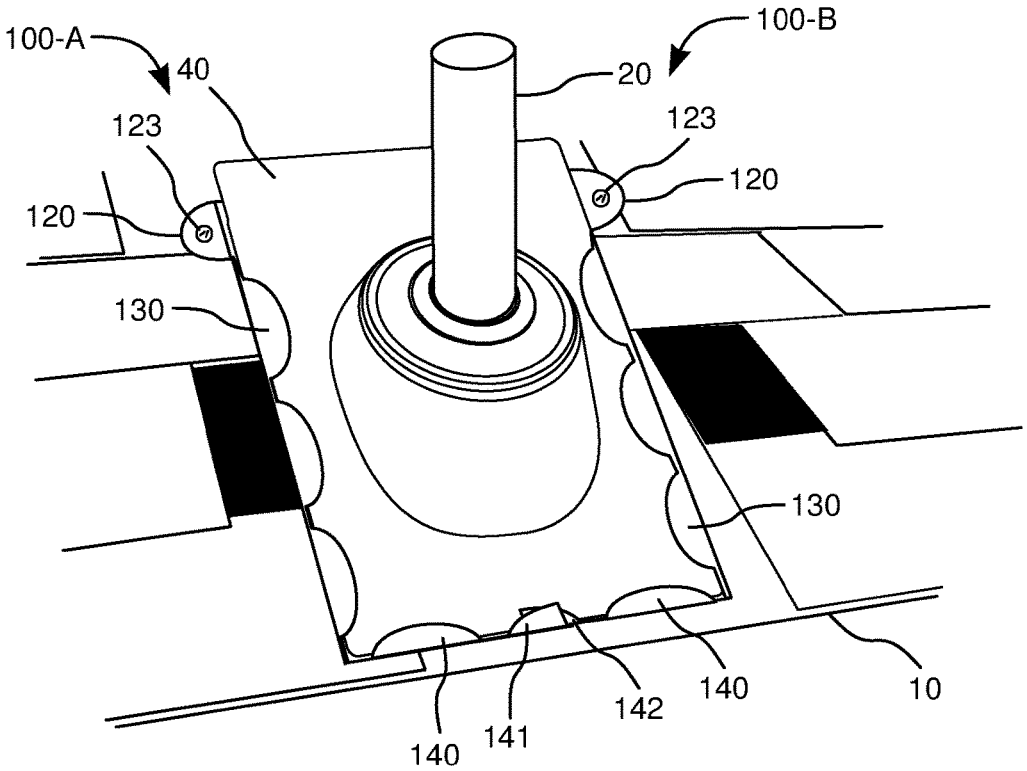
FIG. 26 is a perspective view of the multi-piece flashing clip secured in position on a roof with side clips and end clips folded over the edges of a small pipe flashing unit to secure it in place.

FIG. 26 is a perspective view illustrating the multi-piece flashing clip 100-A, 100-B secured in position on a roof 10 with the side clips 130, the end clips 140, and the end half-clips 141, 142 folded over the edges of the pipe flashing unit 40 to secure it in place. The side clips 130 and the end clips 140 and end half-clips 141, 142 together are foldable to secure the pipe flashing unit 40 in place to the metal base plates 110 within the multi-piece flashing clip 100-A, 100-B. Once the pipe flashing unit 40 has been secured in place via folding the side clips 130 and the end clips 140 and/or end half-clips 141, 142 over its edges, the nails (or any other type fasteners) are therefore covered. Shingles may then be positioned and/or replaced to cover the combination of the pipe flashing unit 40 and multi-piece flashing clip 100-A, 100-B so that there is no need for caulking the nails (or fasteners). The shingles cover the upper portion of the pipe flashing unit 40 so that any rainwater runoff does not reach the nails (fasteners) and the installation does not leak.

As noted previously, during and after installation, the multi-piece flashing clip 100-A, 100-B does not depend on and is not concerned with the particular angle or slope of the roof 10. Since the pipe flashing unit 40 is secured separately to the multi-piece flashing clip 100-A, 100-B, then the angle or slope of the pipe flashing unit 40 and the corresponding roof 10 does not affect the usage or installation concerns of the multi-piece flashing clip 100-A, 100-B. Virtually any roof slope is protectable via simply positioning the multi-piece flashing clip 100-A, 100-B in place along with the pipe flashing unit 40, securing the tabs 120, temporarily removing the pipe flashing unit 40 to permanently secure the multi-piece flashing clip 100-A, 100-B, reinserting the pipe flashing unit 40, and permanently securing the pipe flashing unit 40 via folding the side clips 130 and the end clips 140 and/or end half-clips 141, 142. From there it is a simple matter of replacing the shingles to provide a permanent and weather secure installation to protect from leaks.

As is evidenced in the description above, utilizing the multi-piece flashing clip 100-A, 100-B in concert with a pipe flashing unit 40 eliminates the need for caulking, whether for nails (or fasteners) or waterflow, while also accounting for varying roof slopes. Additionally, the separate metal base plates 110 provide for adjustability and flexibility in utilizing the multi-piece flashing clip 100-A, 100-B for different size pipe flashing units 40 that may be wider or narrower than standard one-size only flashing clips.

From the foregoing description, it will be recognized by those skilled in the art that a flashing clip 100 for providing the securement of a pipe flashing unit 40 without the need for caulking or other sealants has been provided. A flashing clip 100 includes a base plate 110, an aperture 101, a pair of tabs 120, a number of foldable side clips 130, and a number of foldable end clips 140. A pipe flashing unit 40 is secured within the flashing clip 100 via foldable side clips 130 and end clip 140 so that nails or fasteners utilized to secure the flashing clip 100 in place on the roof 10 are covered by the pipe flashing unit 40. Exposed nails are eliminated so that no water or rain reaches the nails under the pipe flashing unit 40. Shingles finish the securement of the pipe flashing unit 40 within the flashing clip 100 by covering its upper portion. In addition, the alternative multi-piece flashing clip 100-A, 100-B with separate metal base plates 110 provides for adjustability and flexibility in utilizing the multi-piece flashing clip 100-A, 100-B for different size pipe flashing units 40 that may be wider than standard one-size only flashing clips.

The subject matter described above is provided by way of illustration only and should not be construed as limiting. Furthermore, the claimed subject matter is not limited to implementations that solve any or all disadvantages noted in any part of this disclosure. Various modifications and changes may be made to the subject matter described herein without following the example embodiments and applications illustrated and described, and without departing from the true spirit and scope of the present disclosure. All such modifications, changes, and/or variations are intended to be included herein within the scope of this disclosure and protected by any and all following claims.

What is claimed is:

1. An assembly, the assembly comprising:
a projection extending upward from a roof;
a flashing material corresponding to the projection, the flashing material positionable around the projection; and
a flashing clip, the flashing clip comprising:
a rectangular base plate that is fastenable to the roof;
a plurality of folded edge clips along opposing edges of said rectangular base plate, the folded edge clips configured to further fold over to secure the flashing material in position within the assembly;
a plurality of folded end clips along a first end of said rectangular base plate, the folded end clips configured to further fold over to secure the flashing material in position within the assembly;
a pair of opposing tabs extended from each of said opposing edges of and adjacent a second end of said rectangular base plate, the pair of opposing tabs being fastenable to the roof; and
an aperture between said opposing edges, the aperture extending from said second end toward said first end, the aperture providing spacing for said rectangular base plate to extend beyond a dimension of the projection for lengthwise adjustability and to partially enclose the projection when said rectangular base plate is positioned on the roof;
wherein the flashing clip is attachable via fasteners to the roof so that the provides for securing placement of the flashing material around the projection without the use of fasteners that would protrude through the flashing material.

2. The assembly of claim 1, wherein said rectangular base plate further comprises two portions divided along a line between said opposing edges and extending from said aperture to said first end, said two portions providing for adjustability of the flashing clip width.

3. The assembly of claim 1, wherein each tab further comprises a tab hole for providing attachment via fasteners to a specific location on the roof.

4. The assembly of claim 1, wherein said rectangular base plate further comprises a plurality of fastener holes for providing permanent attachment via additional fasteners to the roof.

5. The assembly of claim 1, wherein said aperture between said opposing edges extends a distance at least half of the rectangular base plate length.

6. The assembly of claim 1, wherein the rectangular base plate is a thin material.

7. The assembly of claim 6, wherein the rectangular base plate is made from at least one of:
aluminum;
sheet metal;
stainless steel; and
galvanized steel.

8. An assembly, the assembly comprising:
a projection extending upward from a roof;
a flashing material corresponding to the projection, the flashing material positionable around the projection; and
a flashing clip, the flashing clip comprising:
a pair of symmetrical base plates, said pair of symmetrical base plates collectively forming a width adjustable base plate that is fastenable to the roof, each symmetrical base plate including:
an outer edge and an inner edge opposing each other;
a first end and a second end opposing each other;
a plurality of folded edge clips along said outer edge of each symmetrical base plate, the folded edge clips configured to further fold over to secure the flashing material in position within the assembly;
a plurality of folded end clips along said first end of each symmetrical base plate, the folded end clips configured to further fold over to secure the flashing material in position within the assembly;
a tab, said tab extended from said outer edge and adjacent said second end of said symmetrical base plate, the tab being fastenable to the roof; and
an aperture opposite said tab, said aperture extending from said second end toward said inner edge, and extending beyond a dimension of the projection; and
said inner edge of each symmetrical base plate aligned adjacent each other so that said apertures and said base plates collectively provide adjustable spacing of length and width to partially enclose the projection when said base plate is positioned on the roof;
wherein the flashing clip is adjustably attachable via fasteners to the roof so that the flashing clip provides for securing placement of the flashing material around the projection.

9. The assembly of claim 8, wherein each tab further comprises a tab hole for providing attachment via fasteners to a specific location on the roof.

10. The assembly of claim 9, wherein each said symmetrical base plate further comprises a plurality of fastener holes for providing permanent attachment via additional fasteners to the roof.

11. The assembly of claim 8, wherein each aperture extends a distance at least half of the symmetrical base plate length between said second end and said first end.

12. The assembly of claim 8, wherein the symmetrical base plate is a thin material.

13. The assembly of claim 12, wherein the symmetrical base plate is made from at least one of:
aluminum;
sheet metal;
stainless steel; and
galvanized steel.

14. An assembly, the assembly comprising:
a projection extending upward from a roof;
a flashing material corresponding to the projection, the flashing material positionable around the projection; and
a flashing clip, the flashing clip comprising:
a pair of symmetrical base plates, said pair of symmetrical base plates collectively forming a width adjustable base plate that is fastenable to the roof, each symmetrical base plate including a plurality of fastener holes, each symmetrical base plate further including:
an outer edge and an inner edge opposing each other;
a first end and a second end opposing each other;
a plurality of folded edge clips along said outer edge of each symmetrical base plate, the folded edge clips configured to further fold over to secure the flashing material in position within the assembly;
a plurality of folded end clips along said first end of each symmetrical base plate, the folded end clips configured to further fold over to secure the flashing material in position within the assembly;
a tab, said tab extended from said outer edge and adjacent said second end of said symmetrical base plate, said tab further including a tab hole; and an aperture opposite said tab, said aperture extending from said second end toward said inner edge, and extending beyond a dimension of the projection; and said inner edge of each symmetrical base plate aligned adjacent each other so that said apertures and said base plates collectively provide adjustable spacing of length and width to partially enclose the projection when said base plate is positioned on the roof;

wherein the flashing clip is adjustably attachable via fasteners to the roof so that the flashing clip provides for securing placement of the flashing material around the projection.

15. The assembly of claim 14, wherein each aperture extends a distance at least half of the symmetrical base plate length between said second end and said first end.

16. The assembly of claim 14, wherein the symmetrical base plate is a thin material.

17. The assembly of claim 16, wherein the symmetrical base plate is made from at least one of:

aluminum;

sheet metal;

stainless steel; and galvanized steel.

* * * * *